US005244124A

United States Patent [19]

Raffo

[11] Patent Number: 5,244,124

[45] Date of Patent: Sep. 14, 1993

[54] LIQUID CARTRIDGE CONTAINER FOR USE IN A HERBICIDE APPLICATOR

[75] Inventor: David Raffo, Guilden Sutton, United Kingdom

[73] Assignee: Nomix-Chipman Limited, United Kingdom

[21] Appl. No.: 796,423

[22] Filed: Nov. 22, 1991

[30] Foreign Application Priority Data

Nov. 29, 1990 [EP] European Pat. Off. ..... 90313008.6

[51] Int. Cl.[5] ..... B65D 88/54

[52] U.S. Cl. ..... 222/325; 224/148; 141/370; 141/386; 239/375

[58] Field of Search ..... 222/325-327, 222/181, 185, 465.1, 143, 608, 175; 224/148, 32 R; 141/18, 312, 346, 348, 351, 369-370, 390, 383, 386; D9/395; 239/375

[56] References Cited

U.S. PATENT DOCUMENTS

| | | | |
|---|---|---|---|
| 3,540,630 | 11/1970 | Brown | 222/181 X |
| 4,164,306 | 8/1979 | Perrin | 222/325 X |
| 4,530,448 | 7/1985 | Ponyicky | 222/181 |
| 4,662,271 | 5/1987 | Woltermann | 141/18 X |
| 4,673,109 | 6/1987 | Cassia | 222/181 X |
| 4,805,808 | 2/1989 | Larson | 222/185 |
| 5,105,990 | 4/1992 | Leith | 222/185 |

*Primary Examiner*—Andres Kashnikow
*Assistant Examiner*—Kenneth DeRosa
*Attorney, Agent, or Firm*—Merchant, Gould, Smith, Edell, Welter & Schmidt

[57] ABSTRACT

A container 12, for example for containing herbicide for delivery means of a hand-held applicator, has a guide rib 84 for assisting guidance of the container 12 with respect to a handset 2 of the applicator as the container 12 is fitted to the handset 2. The container 12 also has a latching recess 20 for cooperation with a latching element 44 provided in the handset, to retain the container 12 with respect to the handset. The rib 84 tapers in the direction from a base 66 of the container towards an outlet 16, so that the fit between the rib 84 and a slot 24 in a guide 22 on the handset becomes progressively tighter as the container is inserted.

9 Claims, 4 Drawing Sheets

2
8
22
10
54
6
4

54
26
24
22

24
22
26
14
18
10

LIQUID CARTRIDGE CONTAINER FOR USE IN A HERBICIDE APPLICATOR

This invention relates to a container for liquid, and is particularly, although not exclusively, concerned with containers for liquid herbicide, for use with delivery equipment for distributing the herbicide over the ground.

GB-A-2207032 discloses a herbicide applicator to which a container of herbicide is releasably fitted. The container is provided with a guide means for guiding it during insertion into a recess provided on a handset of the applicator, and has an outlet which, when the container is fitted to the handset, engages an inlet fitting provided in the handset. Latching means is provided for retaining the container with respects to the handset, this latching means engaging recesses provided on opposite sides of the container.

According to the present invention there is provided a container of liquid for attachment to equipment for delivering the liquid, the container having a base and an outlet fitting disposed in the container opposite the base, the container being provided with guide means for guiding the container with respect to the delivery equipment during attachment of the container to the delivery equipment, the container also having a latching recess for receiving a latching element for retaining the container with respect to the delivery equipment, characterised in that the guide means comprises a rib at an edge of the container which extends in the direction from the base towards the outlet fitting, the rib being connected to the rest of the container by a necked portion defined by oppositely disposed grooves.

Preferably, the rib tapers in the direction from the base towards the outlet. As a consequence of this, the narrower end of the rib can first be introduced into a guide slot in the delivery equipment, yet more accurate guidance is achieved as the rib is displaced along the guide slot.

Preferably, the latching recess is disposed adjacent the outlet fitting, and on one side only of the container. By providing a single latching recess adjacent to the outlet fitting, reliable and accurate latching of the container can be achieved in a simple manner.

For a better understanding of the present invention, and to show how it may be carried into effect, reference will now be made, by way of example, to the accompanying drawings, in which.

Figures 1, 2, 3:
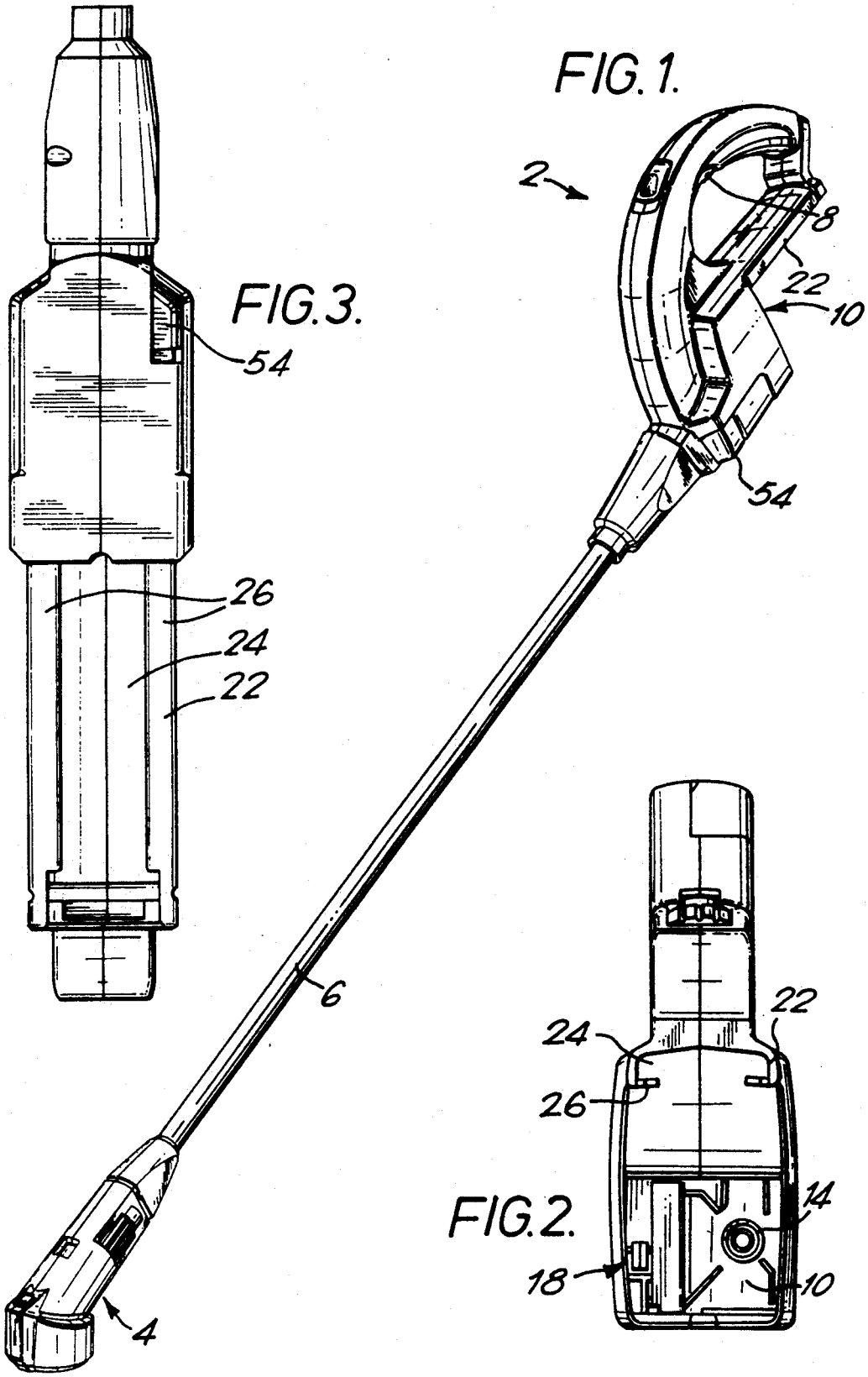
FIG. 1 shows an applicator for delivering a herbicide over the ground.
FIG. 2 is a rear view of the handset of the applicator of FIG. 1.
FIG. 3 is an underneath view of the handset.

The applicator shown in FIG. 1 comprises a handset 2 which carries a delivery head 4 on a support tube 6. The delivery head 4 accommodates an electric motor (not shown) for driving a distribution disc (also not shown) in order to distribute herbicide over the ground under centrifugal force.

The liquid to be distributed, and power for the electric motor, are supplied to the delivery head 4 from the handset 2 through the support tube 6. A valve controlling the flow of liquid and a switch controlling the supply of power are operated by a trigger 8 provided in the handset.

The handset 2 has a recess 10 for receiving a container 12 (see FIGS. 4 and 5) containing the liquid to be delivered. The recess 10 accommodates a connection fitting 14 for engagement with an outlet fitting 16 on the container, and a latching mechanism 18 for engagement with a notch 20 formed in the wall of the container 12.

Figure 4:
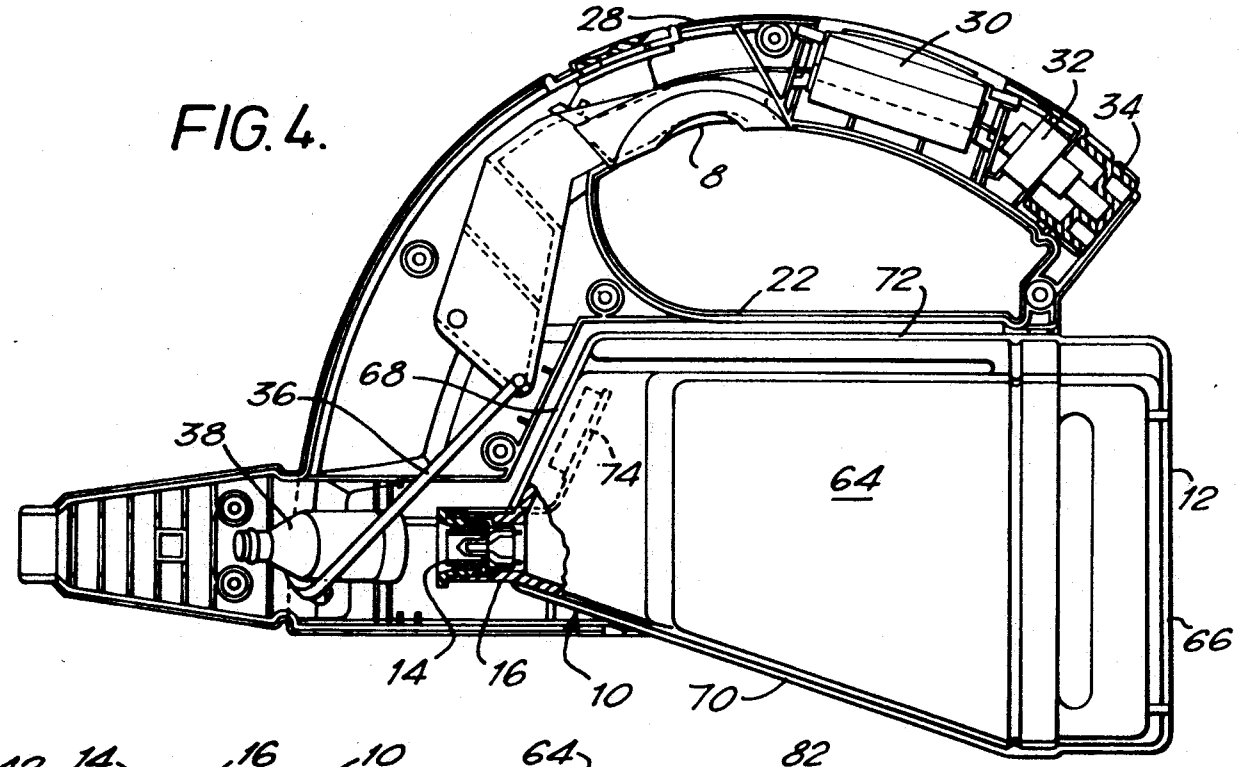
FIG. 4 is a sectioned side view of the handset with as container of herbicide fitted to it.

The handset 2 has a guide 22 extending in the direction of movement of the container 12 into and out of the recess 10. As shown in FIGS. 2 and 3, this guide comprises a track 24 having retaining flanges 26. Referring to FIG. 4, the handset 2 has a curved handle member 28 in which the trigger 8 is mounted. The handle 28 also accommodates one or more batteries 30 for providing the electrical power for the equipment, and a potentiometer 32, controlled by a control knob 34, for regulating the power supply to the spinning disc in the delivery head 4, so as to control the rotational speed of the disc. The trigger 8 is connected by a link 36 to shut-off valve 38 for controlling the flow of herbicide from the container 12 to the delivery head 4, through a flexible tube 40 provided in the support tube 6 (see FIG. 5).

Figure 5:
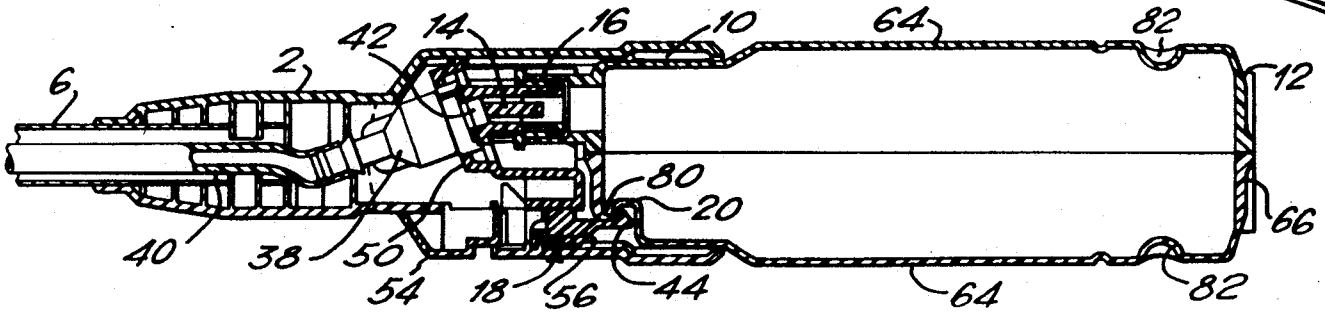
FIG. 5 is a sectioned top view of the handset and container.

As shown in FIG. 5, the connection fitting 14 communicates with the inlet of the valve 38 through a duct 42. The outlet fitting 16 of the container 12 is provided with a self-closing valve of the type disclosed in European Patent Application No. 90303900.6. This valve applies a resilient force on the connection fitting 14 tending to bias the container 12 away from the connection fitting 14.

Figure 6:
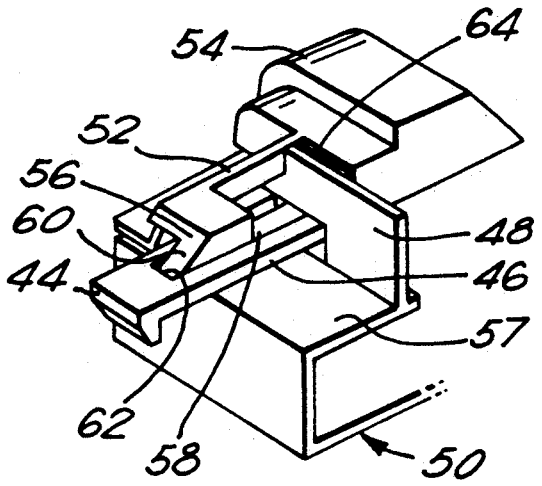
FIG. 6 is a fragmentary view showing a latch mechanism provided in the handset.

The latching mechanism 18, shown in fragmentary view in FIG. 6, comprises a latching element 44 which is connected by a flexible limb 46 to a support member 48 which is part of a partition 50 mounted within the handset 2 and carrying the valve 38. The partition 50, including the flexible limb 46 and the latching element 44 are formed integrally with each other, and comprise a plastic moulding.

The latching mechanism 18 also comprises an operating element 52, which comprises a push button 54 and a projecting nose 56. The push button 54 is situated on the outside of the handset 2, for manual operation by a user of the applicator. The nose 56 extends into a slot 58 formed in the flexible limb 46 of the latching element 44. The nose 56 has an oblique cam surface 60 which cooperates with the end wall 62 of the slot 58. A leaf spring 64 (FIG. 6) acts between the support member 48 and the push button 54 in order to bias the operating element 52 in the direction away from the latching element 44.

Figure 7:
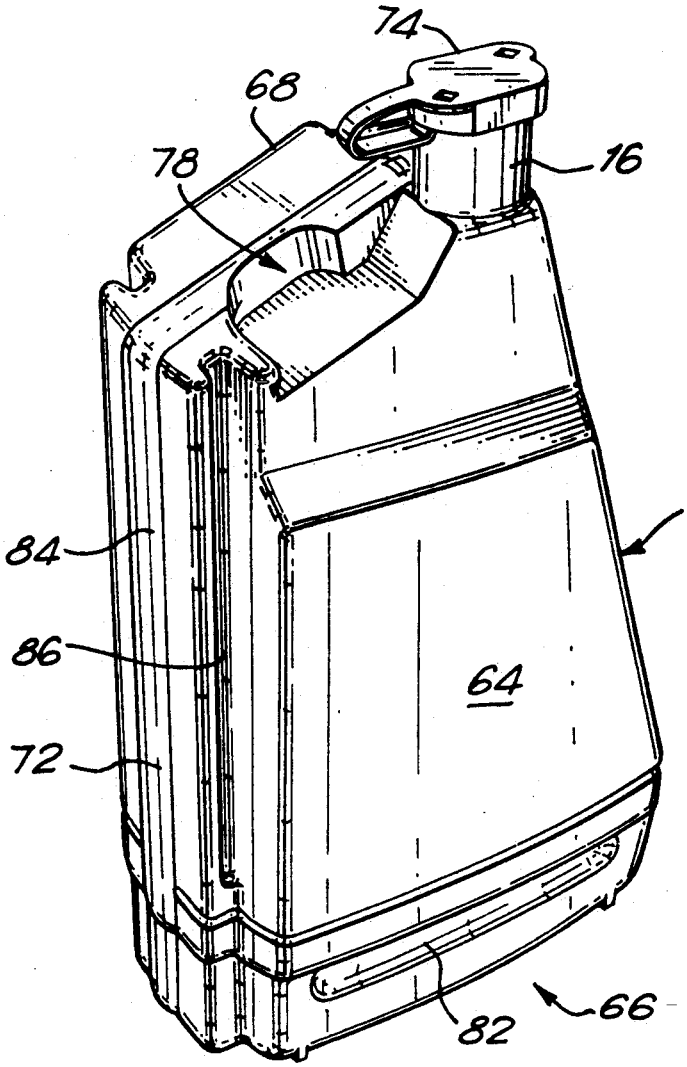
FIG. 7 is a perspective view of the container.
Figure 8:
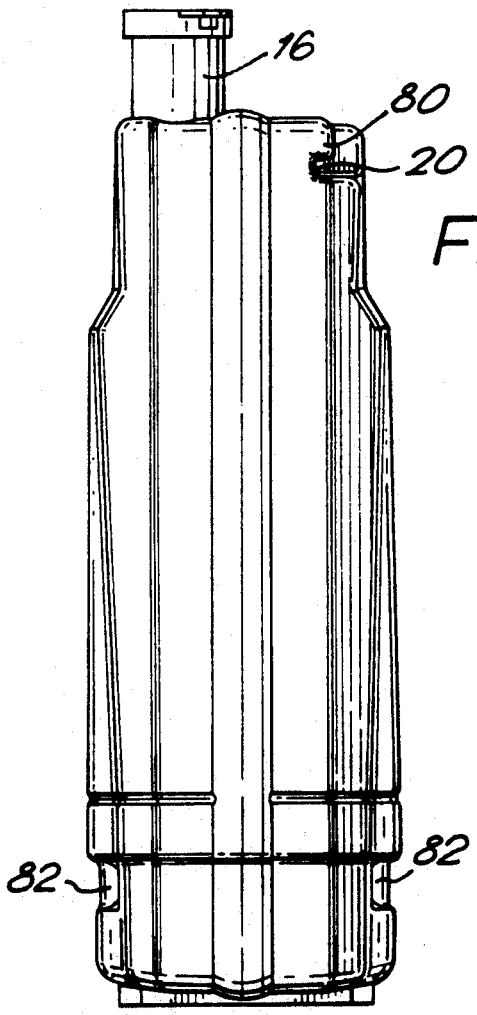
FIG. 8 is an underneath view of the container.
Figure 9:
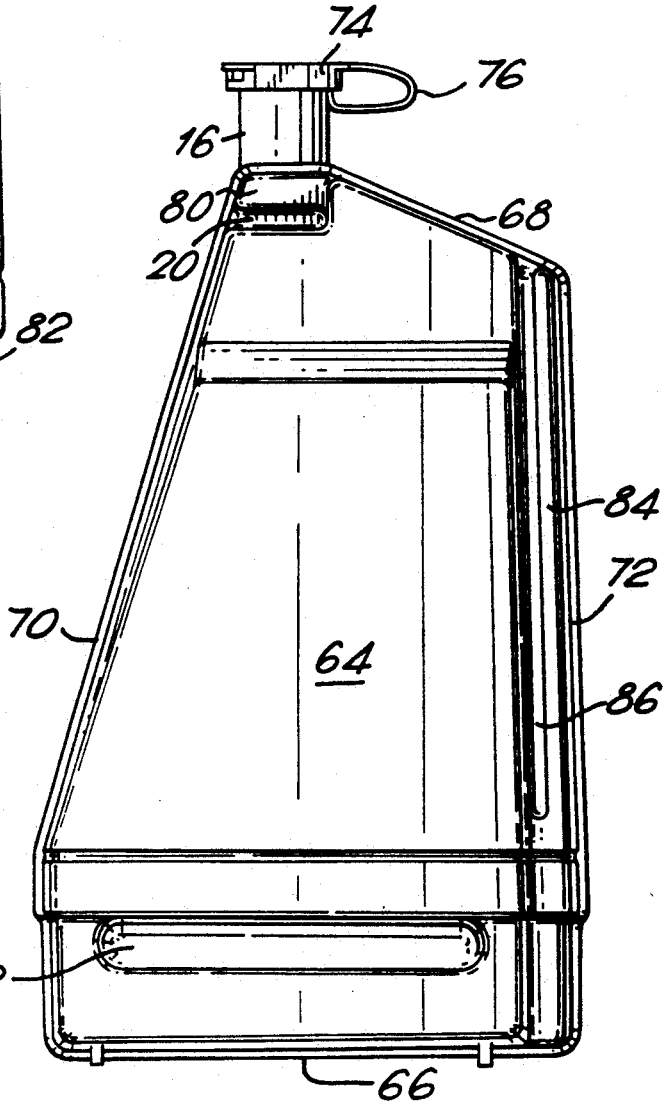
FIG. 9 is a side view of the container.

The container 12 is shown in greater detail in FIGS. 7 to 9. It comprises a moulded body of plastics material, and has two side walls 64, a base 66, a front wall 68, a lower wall 70 and an upper wall 72. The front wall 68 is provided with the outlet fitting 16, which has a removable cap 74. The cap 74 is connected to the outlet fitting 16 by a flexible strap 76 and, when removed from the outlet fitting 16, the cap 74 can be accommodated in a recess 78 provided in the front wall 68.

The notch 20 is provided in the side wall 64 on the side opposite the recess 78, adjacent the front wall 68. It is separated from the front wall 68 by a ridge 80.

Near the base 66, the side walls 64 are provided with shallow depressions 82, to assist in grasping the container 12 for inserting it into, and removing it from, the recess 10. container 12 for inserting it into, and removing it from, the recess 10.

The upper wall 72 is provided with a projecting rib 84 which has a shape generally complementary to that of the slot 24. However, the rib 84 tapers slightly in the direction from the base 66 to the front wall 68. Between the rib 84 and the main body of the container 12, there are oppositely disposed grooves 86, for receiving the flanges 26. The ribs 86 terminate some distance from the base 66.

In order to fit the container 12 to the handset 2, the container is presented from the rear of the handset 2 with the outlet fitting 16 directed towards the recess 10. The leading end of the rib 84 is engaged with the rear end of the slot 24. This requires no great accuracy, as a result of the narrower cross-section of rib 84 at its leading end. The container is then slid forwards, guided by the cooperation between the rib 84 and the slot 24. The tapering shape of the rib 84 means that the fit between the rib 84 and the slot 24 becomes progressively tighter as the container 12 is advanced, so that the outlet fitting 16 is accurately directed at the connection fitting 14 within the recess 10. The two fittings 16 and 14 thus make proper engagement with each other as the container 12 is pushed home. At the same time, the latching element 44 rides over the rib 80, as a result of the tapering end face of the latching element 44 cooperating with the curved profile at the transition between the rib 80 and the front wall 68 of the container 12. The latching element 44 then snaps under the resilience of the limb 46 into the notch 20, so retaining the container 12 in the recess 10, despite the resilient action exerted between the connection fitting 14 and the outlet fitting 16, tending to push the container 12 out of the recess 10.

The act of engaging the container 12 with the handset 2 causes the self-closing valve in the outlet fitting 16 to open, allowing liquid to flow to the valve 38. Operation of the trigger 8, allows the liquid to flow to the delivery head 4, to be discharged from the spinning disc provided in the delivery head 4.

Following use of the applicator, the container 12 is released from the handset 2 by displacing the push button 54 rearwardly. This moves the projecting nose 56 along the guide surface 57, pressing the cam surface 60 against the end 62 of the slot 58. The wedging action thus applied by the projecting nose 56 on the latching element 44 causes the latching element 44 to be displaced against the resilient action of the flexible limb 46, so withdrawing the latching element 44 from the notch 20. This allows the container 12 to be pushed for a short distance outwardly of the recess 10, under the resilient action applied by the self-closing valve as it closes. The container 12 can be then be gripped by means of the depressions 82, and withdrawn from the handset 2.

It should be noted that, since the wedging action applied by the projecting nose 56 on the end of the slot 58 causes the latching element 44 to be displaced against the resilient action of the flexible limb 46, the restoring action of the flexible limb 46 tends to bias the projecting nose 56 away from the latching element 44 and hence tends to provide a restoring action which returns the latching element 44 to the latching position. Thus, separate biasing means such as the leaf spring 64 need not be provided between the support member 48 and the push button 54, to ensure that the latching element 44 returns to the latching position when the push button 54 is released.

I claim:

1. A container of liquid, for attachment to delivery equipment for delivering the liquid, the container having a body and an outlet fitting mounted on the body, the body comprising:

an end wall, the outlet fitting being provided on and projecting from the end wall for cooperation with a connection fitting provided on the delivery equipment;

a base disposed opposite the end wall;

a guide wall which extends between the end wall and the base and which has a guide rib extending from the end wall in a direction towards the base, the guide rib being connected to the guide wall by a necked region defined by two oppositely disposed grooves, whereby the guide rib guides the container with respect to the delivery equipment during attachment of the container to the delivery equipment to cause engagement between the outlet fitting and the connection fitting; and a latching recess provided in the body of the container at a location spaced from the outlet fitting for receiving a latching element for retaining the container with respect to the delivery equipment.

2. A container as claimed in claim 1, wherein the grooves terminate short of the base.

3. A container as claimed in claim 1, wherein the rib tapers in the direction from the base towards the outlet.

4. A container as claimed in claim 1, wherein grip means is provided adjacent to the base for assisting in withdrawal of the container from the delivery equipment.

5. A container as claimed in claim 1, wherein the latching recess is disposed on one side only of the container.

6. A container as claimed in claim 1, wherein the outlet fitting comprises a resiliently self-closing valve.

7. Equipment for delivering a liquid comprising a handset provided with a connection fitting and a latching element, delivery means mounted on the handset and communicating with the connection fitting for delivering the liquid, and a container which is releasably attached to the handset, the container comprising:

a body and an outlet fitting which is mounted on the body, the body comprising:

an end wall, the outlet fitting being provided on and projecting from the end wall for cooperation with the connection fitting;

a base disposed opposite the end wall;

a guide wall which extends between the end wall and the base and which has a guide rib extending from the end wall in a direction towards the base, the guide rib being connected to the guide wall by a necked region defined by two oppositely disposed grooves; and a latching recess provided in the body of the container at a location spaced from the outlet fitting, and the handset comprising an elongate guide having a cross-sectional shape complementary with the cross-sectional shape of the guide rib, which guide receives the guide rib to guide the container with respect to the delivery equipment during attachment of the container to the delivery equipment to cause engagement between the outlet fitting and the connection fitting, the handset latching element engaging the latching recess to retain the container with respect to the delivery equipment.

8. Equipment as claimed in claim 7, wherein the handset is provided with a recess for partially receiving the container, and the elongate guide extends outwardly of the recess.

9. Equipment as claimed in claim 8, wherein the region of the rib adjacent the base is a tighter fit in the slot than the region of the rib adjacent the outlet fitting.

* * * * *